United States Patent [19]

Fujio

[11] Patent Number: 4,995,789

[45] Date of Patent: Feb. 26, 1991

[54] ENCLOSED TYPE ELECTRIC COMPRESSOR

[75] Inventor: Katuharu Fujio, Shiga, Japan

[73] Assignee: Matsushita Electric Industrial Co. Ltd., Osaka, Japan

[21] Appl. No.: 371,471

[22] Filed: Jun. 26, 1989

[30] Foreign Application Priority Data

Jun. 28, 1988 [JP] Japan ..... 63-159997

[51] Int. Cl.[5] ..... F04C 15/00

[52] U.S. Cl. ..... 417/360; 417/902

[58] Field of Search ..... 417/360, 366, 902

[56] References Cited

U.S. PATENT DOCUMENTS

| | | | |
|---|---|---|---|
| 3,003,684 | 10/1961 | Tarleton | 417/902 X |
| 3,836,290 | 9/1974 | Carter | 417/902 X |
| 4,160,629 | 7/1979 | Hidden et al. | 418/55 |
| 4,496,293 | 1/1985 | Nakamura et al. | 417/902 X |
| 4,768,936 | 9/1988 | Etemad et al. | 417/902 X |

FOREIGN PATENT DOCUMENTS

| | | | |
|---|---|---|---|
| 2550201 | 5/1977 | Fed. Rep. of Germany | 417/902 |
| 57-008386 | 1/1982 | Japan . | |
| 59-110884 | 6/1984 | Japan . | |

*Primary Examiner*—John C. Fox

*Attorney, Agent, or Firm*—Panitch, Schwarze, Jacobs & Nadel

[57] ABSTRACT

An enclosed type electric compressor comprising an electric motor, a compressor and an enclosing vessel that contains said electric motor and said compressor therein, wherein a drive spindle of said compressor is linked with a rotor of said electric motor, said drive spindle is supported and a fixing member that is an element of said compressor is pressed into and fixed at the outer periphery of one end of a stator of said electric motor, a bearing frame by which the other end of said drive spindle is supported is pressed into and fixed at the outer periphery of the other end of said stator, and said fixing member and the outer peripheral portion of said pressing and fixing part of said stator on said bearing frame are pressed into and fixed on the inner wall of said enclosing vessel, said respective component parts being concentric so that the axial centers thereof are aligned with each other, so that scattering of the clearance between the stator and the rotor can be decreased, thereby causing balance of electromagnetic attraction force operating therebetween to be maintained and preventing abnormal overload and abnormal vibrations due to biased electromagnetic attraction force, and thus the compressor has high compression efficiency, excellent durability, low vibration, and little noise.

10 Claims, 4 Drawing Sheets

ENCLOSED TYPE ELECTRIC COMPRESSOR

BACKGROUND OF THE INVENTION

1. Field of the invention:

The present invention relates to an enclosing type electric compressor.

2. Description of the prior art:

It is well known that in a scroll compressor having low vibration and low noise characteristics a suction chamber is provided at the outer periphery thereof, a discharge port is installed at the center of an eddy thereof, the compressed fluid may flow only in one way, and this scroll compressor does not need a discharge valve to compress fluid as provided in a reciprocation type or a rotary type compressor and does not require any large space for discharge since the compression load fluctuation and discharge pulsation of the scroll compressor are comparatively small.

Such a structure of this kind as shown in FIG. 4 is well known as a compressor with a high pressure gas-enclosed vessel. This conventional structure is so composed that a drive spindle 207 is supposed on the internal wall of a cylindrical portion of an enclosed casing 226 as fixing means of a compression portion and an electric motor and as supporting means of the drive spindle 207 onto a thin steel-made enclosing casing 226 having good extensibility, which has been produced for lightening the weight of components and lowering the production costs, the extreme outer peripheral portion of steel-made frame 203 having good rigidity, by which stationary scroll 202 is fixed, is pressed and fixed therein, a stator 216 of the electric motor is fixed with bolts (not shown) at the lower part of the frame 203, and the drive spindle 207 is supported by means of bearings 218 and 214 of the projection 299 toward the side of the electric motor. (Japanese Laid-Open Pat. Publication No. 59-110884).

Also, as shown in FIG. 5, in another structure that a stator of the electric motor 303 is pressed and fixed on the internal wall of the enclosing casing 301, the outer peripheral portion of the frame 306 of the compression portion by which the drive spindle 307 is supported is pressed and fixed at the lower internal wall of the enclosing casing 301, and the drive spindle 307 is supported by the projection 399 at the electric motor side of the frame 306 is known, too. (Japanese Laid-Open Pat. Publication No. 57-8386).

However, in such a construction a stator 216 whose weight is comparatively heavy, is fixed only at the end of the frame 203 as shown in FIG. 4, the clearance between the outer periphery of a rotor 215 of the electric motor and the inner periphery of the stator 216 is imbalanced, and fluctuation may be generated in force by which the rotor 215 is electrically attracted to the stator 216 when the drive spindle 207 supported by the bearings 218 and 214 rotates, thereby causing the drive spindle to be bent. Furthermore, load operating on the bearings 218 and 214 and an electromagnetic reaction force operating on the fixing end portion of electric motor of the frame 203 fluctuate and become excessive by overlapping the centrifugal force of the rotor 215 thereon. For this reason, the frame 203 and the enclosing case 226 vibrate and cause noises. In addition, as the bearing of the drive spindle 207 is supported only by the frame 203, the distance between the bearings 218 and 214 cannot be sufficiently long and the angles of inclination of the drive spindle, which may be generated within the range of the clearance of the bearings, become large. For this reason, biased contact may occur on the sliding surface of the bearings 218 and 214, thereby causing the bearings to be exposed to abnormal wearing and seizure.

In such a construction that the stator of the electric motor 303 and the frame 306 of the compression portion are separately pressed and fixed on the inner wall of the cylindrical portion of the enclosing casing 301 and the drive spindle 307 is supported only by the frame 306 as shown in FIG. 5, there is a problem that electromagnetic vibrations of the electric motor 303 and vibrations of the frame 306, resulting from scattering of the clearance between the stator and the rotor of the electric motor 303 as well as in the above case, may spoil various characteristics of a scroll compressor such as low vibration, low noise, high efficiency and high reliability.

As a method to remove the above-mentioned problems, USP 4,160,629 discloses a scroll compressor with a construction that the drive spindle is supported at both the ends of an electric motor. In this case, the enclosing case, the electric motor and bearings at two points are separately composed, and it is very difficult to attain completed axial alignment among these components, resulting in such various problems as biased contact of the bearings, an increase in input and a lowering of durability. Thus, it has been highly expected that an enclosed type electric compressor having high compression efficiency, high durability, low vibration, and little noise will be developed.

SUMMARY OF THE INVENTION

The enclosed type electric compressor of this invention, which overcomes the above-discussed and numerous other disadvantages and deficiencies of the prior art, comprises an electric motor, a compressor and an enclosing vessel that contains the electric motor and the compressor therein, wherein a drive spindle of the compressor is linked with a rotor of the electric motor, the drive spindle is supported and a fixing member that is an element of the compressor is pressed into and fixed at the outer periphery of one end of a stator of the electric motor, a bearing frame by which the other end of the drive spindle is supported is pressed into and fixed at the outer periphery of the other end of the stator, and the fixing member and the outer peripheral portion of the pressing and fixing part of the stator on the bearing frame are pressed into and fixed on the inner wall of said enclosing vessel, the respective component parts being concentric so that the axial centers thereof are aligned with each other.

In a preferred embodiment, the bearing frame by which the drive spindle is directly supported is used as the fixing member of the compressor which is pressed into and fixed at the outer periphery at one end of the stator.

In a preferred embodiment, the material of a cylindrical portion of the enclosing vessel is made of steel and the thermal expansion coefficient of members to be pressed into and fixed at the outer periphery at both the ends of the stator is larger than that of the enclosing vessel.

In a preferred embodiment, members to be pressed into and fixed at the outer periphery at both the ends of the stator are made of aluminum alloy, a composite containing aluminum alloy and carbon fibers, and/or a composite containing carbon fibers and resins, thereby causing the rigidity to be strengthened.

In a preferred embodiment, the thermal expansion coefficient of the material of a body frame of the compressor is remarkably larger than that of the enclosing vessel, a thin, loop-shaped sleeve made of a material whose thermal expansion coefficient corresponds to that of the enclosing vessel is pressed into and fixed at the outer periphery at the other end of the body frame, and the extreme outer portion of the sleeve is internally tangential to and fixed at the inner wall of the enclosing casing.

The above construction of the enclosed type electric compressor of this invention can reduce scattering of the clearance between the inner diametrical surface of the stator and the outer surface of the rotor of the electric motor, so as to keep the balance of electromagnetic attraction operating between the stator and the rotor, so that the drive spindle and bearings to support the drive spindle can be prevented from abnormal overload and abnormal vibration, and an increase in the rigidity of each component by sandwiched structure of the stator, the fixing members and the enclosing casing can also attained.

Thus, the invention described herein makes possible the objective of providing an enclosed type electric compressor having high compression efficiency, excellent durability, low vibration, and little noise.

Still other objects and advantages of the invention will become apparent from the description in the preferred embodiment hereinafter.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
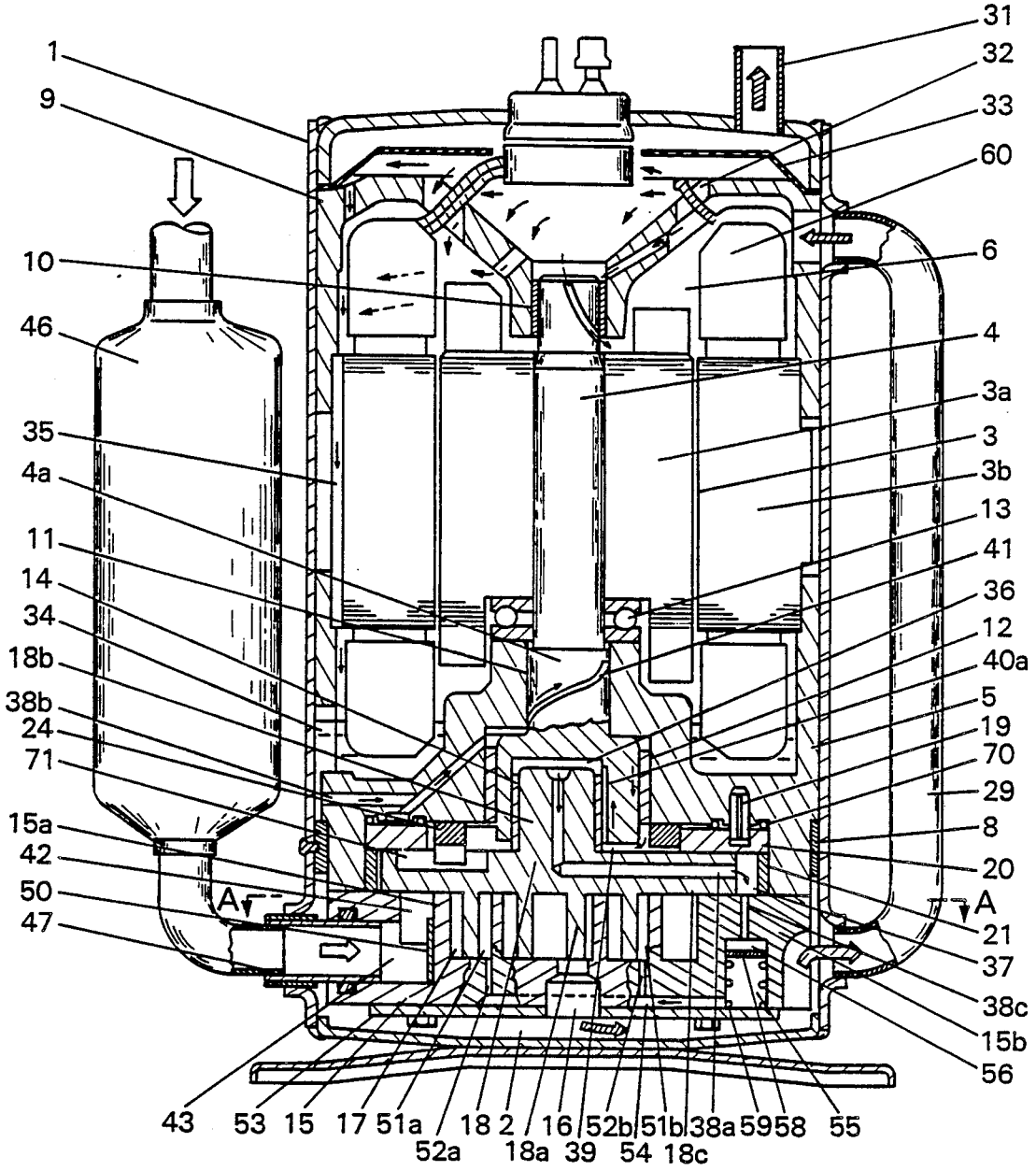
FIG. 1 is a sectional side view showing a scroll refrigerant compressor of this invention.

FIG. 1 shows a scroll compressor of this invention, wherein the reference numeral 1 is a steel-made enclosing casing that is formed by a thin steel plate, the whole inside thereof being in high pressure atmosphere that communicates with a discharge chamber 2. A motor 3 is provided at the upper part of the casing 1 and a compressor is installed at the lower part thereof. The inside of the enclosing casing 1 is divided into a motor chamber 6 and the discharge chamber 2 by means of a body frame 5 of the compressor section by which a drive spindle 4 fixed to the rotor 3*a* of the motor 3 is supported. The body frame 5 is made of aluminum alloy which is superior in heat transmission property, mainly aiming at lightening the weight and thermal dispersion of the bearings, and a loop-shaped thin steel liner 8 that is excellent in weldability is shrink-fitted and fixed in the outer periphery of the body frame 5. The outer periphery of the liner 8 is internally tangential to the inner wall of the enclosing casing 1, and is partially welded and fixed to the enclosing casing 1 by the means described in the Japanese Utility Model Publication No. 50-15609.

The outer periphery at both the ends of the stator 3*b* of the motor 3 is pressed into, and supported and fixed by means of aluminum alloy bearing frame 9 and the body frame 5, both which are pressed into and fixed at the inner wall of the enclosing casing 1. The drive spindle 4 is supported by an upper bearing 10 provided at the bearing frame 9, a lower bearing 11 provided at the upper part of the body frame 5, a main bearing 12 provided at the central part of the body frame 5 and by a thrust ball bearing 13 provided between the upper end surface of the body frame 5 and the lower end surface of the rotor 3*a* of the motor 3, and an eccentric bearing 14 which is eccentric from the main spindle of the drive spindle 4 is provided at the lower part of the drive spindle 4.

A fixing scroll 15 which is made of aluminum alloy is fixed at the lower end surface of the body frame 5, and the fixing scroll 15 consists of an eddy-shaped fixing scroll lap 15*a* and an end plate 15*b*. A discharge port 16 which can open at the start of winding of the fixing scroll lap 15*a* is provided at the central part of the end plate 15*b*, so that the discharge port 16 can communicate with the discharge chamber 2. A suction chamber 17 is provided at the outer periphery of the fixing scroll lap 15*a*.

An aluminum alloy swivel scroll 18 which consists of an eddy-shaped swivel scroll lap 18*a* that constitutes the compressor chamber in engagement with a fixed scroll lap 15*a*, a swivel axis 18*b* supported at the eccentric bearing 14 of the drive spindle 4 and a lap supporting disk 18*c* is arranged, being surrounded by the fixed scroll 15, the body frame 5 and the drive spindle 4, and a sleeve 19 made of high tensile strength steel is shrink-fit and the surface of the lap supporting disk 18*c* is treated so as to be hardened.

A spacer 21 is installed between a thrust bearing 20 which can move in the axial direction as it is restricted by a parallel pin 19 fixed at the body frame 5 and the end plate 15*b* of the fixing scroll 15, and the dimension of the spacer 21 in the axial direction is set to be larger by about 0.015 to 0.020 mm than the thickness of the lap supporting disk 18*c* to increase the sealing property on the slideway by oil film.

Figure 2:
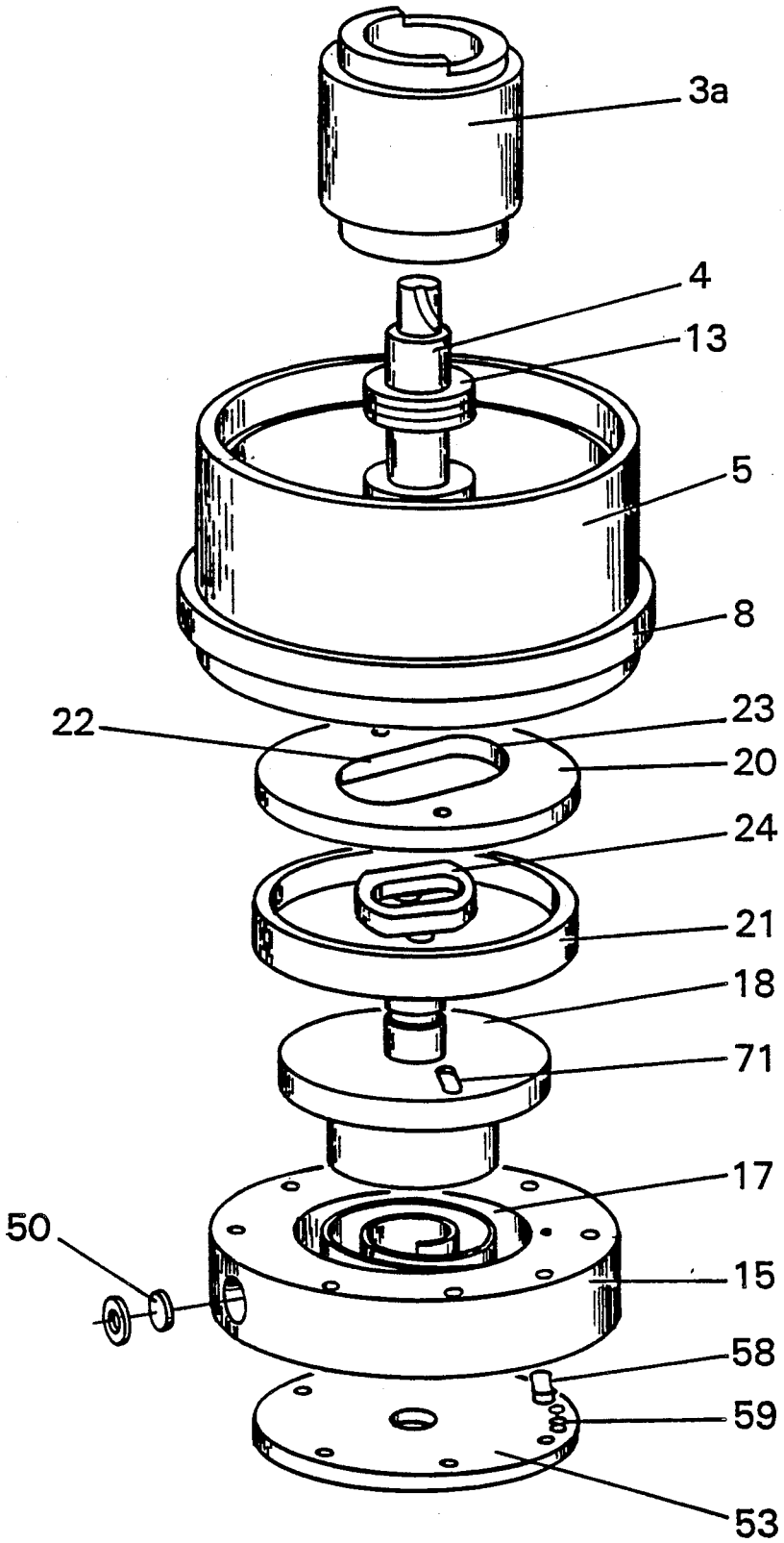
FIG. 2 is a perspective view showing the decomposed components of the compressor shown in FIG. 1.

A space 36 of the eccentric bearing between the bottom of the eccentric bearing 14 of the drive spindle 4 and the end portion of the swivel axis 18*b* of the swivel scroll 18 communicates with the space 37 at the outer peripheral portion of the lap supporting disk 18*c* by an oil port A38*a* provided at the swivel axis 18*b* and at the lap supporting disk 18*c*. As shown in FIG. 2, the thrust bearing 20 is formed into a through-hole in such a shape that the central portion thereof consists of two parallel linear portions 22 and two circular bent portions 23 communicated with the linear portions 22.

An Oldham ring 24 of preventing the swivel scroll from self-rotation is made of light alloy or resin material which is suitable for the formation thereof by a sintering process and injection molding process, and consists of a thin loop-like plate, both surfaces of which are parallel to each other, and a pair of parallel key portions installed at one surface. The outer profile of the loop-like plate consists of two parallel linear portions and two circular bent portions communicated with these linear portions each other. The linear portions are engaged with the linear portions of the through-hole of the thrust bearing 20 with only a minute clearance and is slidable thereon. In addition, the side of the parallel key portion is crossed of a right angle at the central portion of the linear portion and is engaged with a pair of key grooves 71 provided at the lap supporting disk 18*c* of the swivel scroll 18 with only a minute clearance and is set so as to be slidable. Moreover, a dent (not shown) installed at the root of the parallel key portions functions as a passage for lubrication oil.

A release clearance 27 of about 0.1 mm is provided between the body frame 5 and the thrust bearing 20, a loop-like groove 28 is provided at the body frame 5 opposite to the release clearance 27, and a rubber-made seal ring 70 which surrounds the looplike groove 28 is mounted between the body frame 5 and the thrust bearing 20.

The upper part of the motor chamber 6 communicates with the discharge chamber 2 by means of a bypass discharge pipe 29 connected therebetween, passing through the side wall of the enclosing casing 1, the portion of an opening to the motor chamber 6 of the bypass discharge pipe 29 is opposite to the side of the upper coil end 30 of the stator 3, and the upper opening end of the bypass discharge pipe 29 communicates with the discharge pipe 31 connected to the upper surface of the enclosing casing 1 by means of a punching metal 33 having many pores arranged therebetween.

An oil reservoir 34 of the discharge chamber installed at the lower part of the motor chamber 6 communicates with the upper part of the motor chamber 6 by means of a cooling passage 35 provided by cutting a part of the outer periphery of the stator 3*b* of the motor 3. The oil reservoir 34 of the discharge chamber communicates with a loop-like groove 28 by way of an oil port B38*b* provided at the body frame 5. The oil reservoir 34 also communicates with the back pressure chamber 39 of the swivel scroll 18 in which the Oldham ring 24 is arranged, through a minute clearance at the slideway of the main bearing 12. It further communicates with the eccentric bearing space 36 by way of an oil port A40*a* provided at the eccentric bearing 14.

An oil port B38*b* provided at the body frame 5 communicates with a spiral oil groove 41 provided on the surface of the lower bearing 4*a* corresponding to the lower bearing 11 of the drive spindle 4. The winding direction of the above spiral oil groove 41 is so determined that a screw pumping action can be generated by the utilization of viscosity of lubrication oil when the drive spindle 4 rotates clockwise, and the end port of the spiral oil groove is formed up to on the way of the lower bearing 4*a*.

The fixing scroll 15 is furnished with a suction hole 43 which is intercrossed with a right angle with the extreme outer periphery of the fixing scroll lap 15*a* and is open to the suction chamber 17. Besides, a suction pipe 47 of an accumulator 46 is connected to the suction hole 43 and the suction hole 43 is provided with a check valve 50.

The first compression chamber (not shown herein) communicating with the suction chamber 17 or the second compression chambers 51*a* and 51*b* not communicating with both the suction chamber 17 and the discharge chamber 2 and the space 37 at the outer periphery portion are communicated with each other by means of an injection passage which comprises small diametered injection holes 52*a* and 52*b* which are open to the second compression chambers 51*a* and 51*b* and are provided at the end plate 15*b*, and injection groove 54 formed by the end plate 15*b* and a resin-made heat resisting cover 53, and an injection passage 55 formed by a staged oil port C38*c* which is open to the space 37 at the outer periphery. A thin steel check valve 58 having a notch (not shown herein) at a part of the outer periphery thereof and a coil spring 59 are arranged at the large-diametered portion 56 of an oil port C38*c*.

The coil spring 59 energizes the check valve 58 by being pushed by the heat resisting cover 53 at all times. The opening position of the oil port C38*c* to the space 37 at the outer periphery is so determined that the space 37 at the outer periphery can communicate with the oil port C38*c* when the swivel scroll 18 shifts up to the vicinity where the capacity decreasing process of the third compression chamber 60 (not shown herein) which communicates with the discharge port 16 and they can be shut down by the lap supporting plate 18*c* at all the other times than the above.

The above-mentioned scroll fluid compressor operates as follows:

As the drive spindle 4 is rotated by the electric motor 3, the swivel scroll 18 swivels and the suction refrigerant gas including a lubrication oil flows from a freezing cycle connected to a compressor into the suction chamber 17 by passing through the suction pipe 47, the suction hole 43, and the suction passage 42 by turns, which are connected to the accumulator 46. Then, the suction refrigerant gas flows into the compression chamber through the first compression chamber (not shown herein) formed between the swivel scroll 18 and the fixing scroll 15 and flows into the second compression chambers 51*a* and 51*b* and the third compression chamber (not shown herein) by turns, which will be an enclosed space and is compressed therein. Subsequently the refrigerant gas is discharged to the discharge chamber 2 via the discharge port 16 at the central port.

After the discharged refrigerant gas including lubrication oil is again returned into the motor chamber 6 of the compressor through the bypass discharge pipe 29 routed outwards of the compressor, the gas is discharged to an external freezing cycle from the discharge pipe 31. However, when the gas flows into the motor chamber 6, it is brought into collision with the upper coil end 30 of the motor 3 and is adhered to the surface of the motor windings, so that a part of the lubrication oil is separated. Thereafter, when the gas passes through a draw-out hole 32 provided on the bearing frame 9, the flow thereof is changed, and/or when the gas passes through the pores of the punching metal 33, the lubrication oil is effectively separated by inertia force or by being adhered to the surface. A part of the lubrication oil separated from the discharge gas passes through the cooling passage 35 together with the remaining lubrication oil after the slideway of the upper bearing is lubricated, and is collected in the oil reservoir 34 of the lower discharge chamber for cooling the motor 3.

The lubrication oil in the oil reservoir 34 of the discharge chamber is supplied to the thrust ball bearing 13 by a screw pumping action of the spiral oil groove 41 provided on the surface of the lower bearing 4*a* of the drive spindle 4, and when the lubrication oil passes through a minute clearance for bearing at the end of the lower bearing 4*a*, the atmosphere of the discharge refrigerant gas of the motor chamber 6 is interrupted from the space at the upstream side of the main bearing 12 by virtue of the sealing effect of the oil film.

When the lubrication oil including dissolved discharge refrigerant gas in the oil reservoir 34 of the discharge chamber passes through a minute clearance of the main bearing 12, the pressure thereof is reduced to the interim pressure between the discharge pressure and the suction pressure and the lubrication oil flows into the back pressure chamber 39. After that, it flows into the space 37 at the outer periphery through the oil groove A40*a* of the eccentric bearing 14, the space 36 of the eccentric bearing and the oil port A38 passing through the swivel scroll 18. The lubrication oil further flows into the second compression chambers 51*a* and 51*b* through the oil port C38*c* which is intermittently opened, the injection groove 54 and the injection holes 52*a* and 52*b*. Thereby all the slideways which exist on the way of circulation of the above lubrication oil are effectively lubricated.

As the oil reservoir 34 of the discharge chamber communicates with the loop-like groove 28 and the release clearance 27, the thrust bearing 20 is energy-charged by the back pressure and is brought into contact with the spacer 21. Thus, the lap supporting plate 18*c* of the swivel scroll 18 can smoothly slide as a minute clearance is kept between the thrust bearing 20 and the end plate 15*b* of the fixing scroll 15. At the same time, the clearance between the end face of the fixing scroll lap 15*a* and the lap supporting disk 18*c* and between the end face of the swivel scroll lap 18*a* and the end plate 15*b* can be delicately maintained, thereby causing the gas between the adjacent compression chambers to be prevented from leakage.

Lubrication oil injected to the second compression chambers 51*a* and 51*b* is joined in the lubrication oil which is flown into the compression chambers together with the suction refrigerant gas, thereby causing a minute clearance between the adjacent compression chambers to be sealed by oil film and gas to be prevented from leakage. After that, the lubrication oil is again discharged into the discharge chamber 2 together with the compressed air as lubricating the slideway between the compression chambers.

Lubrication oil differentially supplied into the back pressure chamber 39 causes the charging force of intermediate pressure to operate on the swivel scroll 18 and the lap supporting disk 18*c* to be pushed to the slideway with the end plate 15*b* for sealing by oil film. Accordingly, the communication between the space 37 at the outer periphery and the suction chamber 17 is interrupted, and the clearance of a slideway between the thrust bearing 20 and the lap supporting disk 18*c* is lubricated and sealed.

As for the temperature distribution in the compressor, while running the compressor, the temperature of the motor 3 is the highest and that of the body frame 5 and the bearing frame 9 is the next highest. The temperature of the enclosing casing 1 which is adjacent to the atmosphere is the lowest. The temperature of all the other parts differ according to the running conditions. However, the intermediate temperature between the enclosing casing 1 and the body frame 5 is maintained.

The temperature of the body frame 5 made of aluminum alloy rises in company with an increase in the discharge pressure due to compression heat on running the compressor and friction heat on the slideways, and the thermal expansion thereof causes the dimensions of the end portions and the outer peripheral portions, by which the stator 3*b* is fixed, to be increased. Thus, the outer peripheral portion of the thin steel-made loop-like sleeve 8 which is in contact with the above outer peripheral portion and whose thermal expansion coefficient is smaller than that of aluminum alloy is expanded. And partial minute clearance between the inner wall of the enclosing casing 1 which is minutely deformed due to welding on assembling and the outer peripheral surface of the sleeve 8 is eliminated, thereby causing the contact face pressure between both the members to be increased. In addition, the aluminum alloy bearing frame 9 is thermally expanded in the same way as the body frame 5, thereby causing the inner wall of the enclosing casing 1 to be minutely increased. Thus, as a result of annulment of this clearance, direct communication between the discharge chamber 2 and the motor chamber 6 in the enclosing casing 1 goes away.

Accordingly, fixing among the stator 3*b* of the motor 3, the body frame 5 and the enclosing casing 1 and fixing among the stator 3*b*, the bearing frame 9 and the enclosing casing 1 are strengthened. And the drive spindle 4 and the rotor 3*a* are tightly supported by the supporting members of bearings, whose fixing portion has been strengthened, and they can silently rotate.

After the compressor comes to a stop, the clearance between the outer periphery of the sleeve 8 and the inner wall of the enclosing casing 1 is restored to its original state as respective components are gradually cooled down.

As described above, according to the preferred embodiment of the invention, a compression portion comprising the motor 3 consisting of the rotor 3*a* and the stator 3*b*, the body frame 5, the fixing scroll 15, the swivel scroll 18, the Oldham ring 24 to prevent the swivel scroll 18 from self rotation, the drive spindle 4 which is supported at the body frame 5 and drives the swivel scroll 18, etc. is housed in the enclosing casing 1 made of thin steel having extensibility. The drive spindle 4 of the compression portion is linked with the rotor 3*a* of the motor 3. One end of the body frame 5 which supports the drive spindle 4 and is a component member of the compression portion is pressed into and fixed at the outer periphery at one end of the stator 3*b* of the motor 3. The bearing frame 9 which supports the other end of the drive spindle 4 is pressed into and fixed at the outer periphery at the other end of the stator 3*b*. The outer peripheral portion of the said pressing and fixing part of the stator of the body frame 5 and the bearing frame 9 is pressed into and fixed at the inner wall of the enclosing casing 1. Thus, by so composing the rotor 3*a* and the stator 3*b* of the motor 3, the body frame 5, the bearing frame 9, the drive spindle 4, and the center of the main spindle at the inner wall of the enclosing casing 1 as to be concentric, scattering of the clearance between the inner wall face of the stator 3*b* of the motor 3 and the outside face of the rotor 3*a* of the same can be decreased, thereby causing balance of electromagnetic attraction force operating between the stator 3*b* and the rotor 3*a* to be maintained and preventing abnormal overload and abnormal vibrations due to biased electromagnetic attraction force operating on the lower bearing 11 of the body frame 5 by which the drive spindle 4 is supported, the upper bearing 10 of the bearing frame 9 and the drive spindle 4. Thus, power loss and wearing of the slideways of bearings can be decreased.

In addition, since it is possible to make the distance longer between the upper bearing 10 and the lower bearing 11, which are arranged at both the sides of the motor 3, the compression load exerting on both the bearings can be distributed roughly uniformly and the durability of these bearings can be increased. Moreover, the inclination of the drive spindle 4 is small, and the inclination of the clearance between the stator 3*b* and the rotor 3*a* can be made small, too. For this reason, it is possible to maintain the balance of the electromagnetic attraction force exerting between the stator 3*b* and the rotor 3*a*, and it is also possible to prevent seizure of the bearings resulting from biased contact of the slideways of the bearings due to the inclination of the drive spindle 4.

Moreover, since the portion by which the stator 3*b* of the motor 3 is supported is formed of a sandwiched structure by contact under pressure with the stator 3*b*, the body frame 5 (or the bearing frame 9), and the enclosing casing 1, it is possible to increase the rigidity of respective component members. For this reason, not only vibrations which may be produced at the bearings can be lessened but also transmission of noises and vibrations onto the outer surface of the enclosing casing 1 can be prevented.

Also, according to the above embodiment, since the material of the cylindrical portion of the enclosing casing 1 is made of a thin steel plate and the body frame 5 and the bearing frame 9 are made of aluminum alloy, whose thermal expansion coefficient is larger than that of the enclosing casing 1, thermal expansion stress resulting from the component temperature-rise and the temperature-difference between the parts (the temperature of the stator 3*b* is the highest and that of the enclosing casing 1 is the lowest) on running the compressor operates on these components so that the adhesion of the body frame 5 and the bearing frame 9 to the enclosing casing 1 can be strengthened, thereby causing the reliability of these parts to be heightened.

Furthermore, according to the above embodiment, since the body frame 5 which is pressed into and fixed at the outer periphery at both the ends of the stator 3*b* of the motor 3 is made of a material having light specific gravity such as aluminum alloy, low vibration and low noise of the compressor can be maintained even though the number of components of the bearings by which the drive spindle 4 is supported is increased.

Also according to the above embodiment, since the body frame 5 which is indirectly fixed at the inner wall of the enclosing casing 1 made of thin steel plate having extensibility is made of aluminum alloy whose thermal expansion coefficient is remarkable larger than that of the material of the enclosing casing 1, a thin, loop-like sleeve 8 made of a material such as that of the enclosing casing 1 is pressed into and fixed at the outer periphery of the body frame 5 and the extremely outer peripheral portion of the sleeve is internally tangential to and fixed at the inner wall of the enclosing casing 1, the temperature of the body frame 5 and the enclosing casing 1 which constitute a part of the compression portion rises due to compression heat of refrigerant gas, friction heat of the slideways and heating of the motor 3 during running of the compressor, thereby causing the temperature of the body frame 5 to be higher that of the enclosing casing 1 whose surface is exposed to the atmosphere. For this reason, the thermal deformation of the outer periphery of the body frame 5 is remarkably larger than that of the inner wall of the enclosing casing 1 and than that of the inner and outer peripheral portion of the sleeve 8, thereby causing a thin, loop-shaped sleeve 8 to be expanded due to the thermal expansion stress and the contact surface pressure among the body frame 5, the sleeve 8 and the inner wall of the enclosing casing 1 to be increased. Therefore, it is possible to strengthen the fixing among three parts such as the enclosing casing 1, the sleeve 8 and the body frame 5. Besides, a minute clearance between the inner wall of the enclosing casing 1 and the sleeve 8 resulting from minute deformation of the enclosing casing 1 due to welding on assembling can be completely eliminated by dimensional extension of the body frame 5 and the sleeve 8. Thus, even though minute vibrations that may occur in accompanying with rotation of the drive spindle 4 and compression of the refrigerant gas is transmitted to the inner wall of the enclosing casing 1 by way of the body frame 5, the enclosing casing 1 can be prevented from resonance together with the sleeve 8 and the body frame 5.

Furthermore, even though rotation load exerts on the drive spindle 4, the drive spindle 4 makes so-called mashing movements and bending moment as it operates on the body frame 5 as tho outer peripheral portion at both the ends of the body frame 5 is pressed into and fixed at the inner wall of the enclosing casing 1, the axial center of the body frame 5 will not be inclined to the inner wall of the enclosing casing 1 and the air gap of the motor 3 can be maintained uniformly at all times. Therefore, vibrations of the body frame 5 and biased contacting of bearings can be prevented, thereby causing the wearing of bearings to be prevented, and the rigidity of the enclosing casing 1 to be increased. Therefore, minute vibrations due to expansion and contraction of the enclosing casing 1, which results from discharge pulsation of the discharge refrigerant gas, can be reduced.

In the above embodiment, although the body frame 5 and the bearing frame 9 are made of aluminum alloy, a composite material that contains aluminum alloy and carbon fiber whose thermal expansion coefficient is drawn near that of aluminum alloy and a composite material that contains carbon fiber and resins whose rigidity is increased more than that of aluminum alloy can be used instead.

Figure 3:
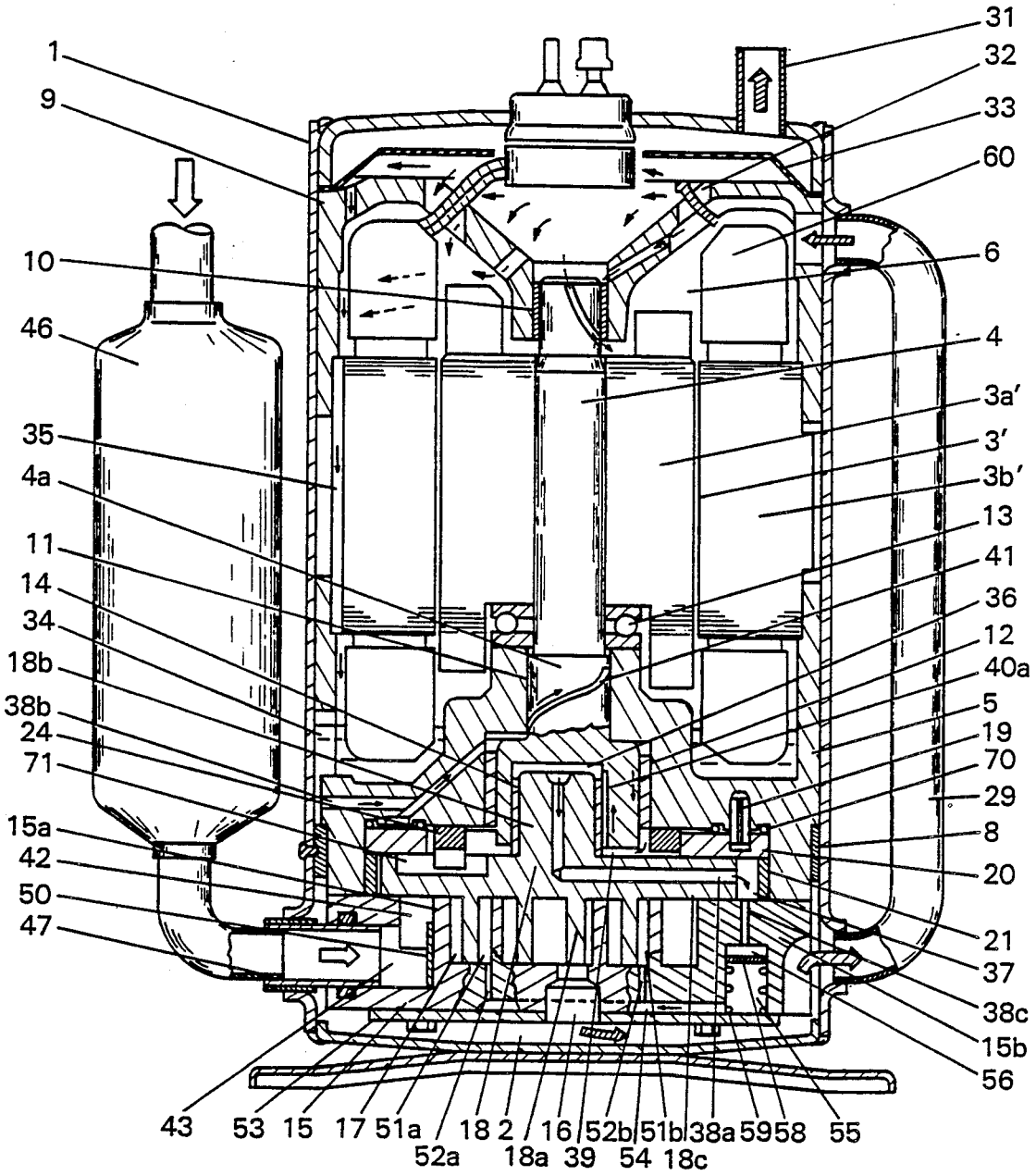
FIG. 3 is a sectional side view showing another scroll refrigerant compressor of this invention.
Figure 4:
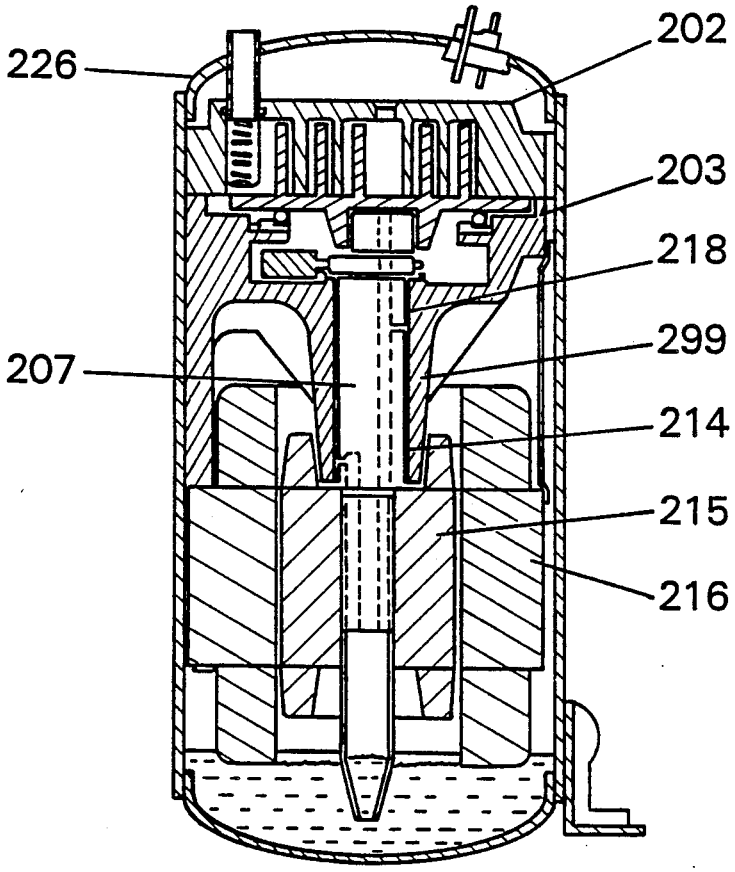
FIGS. 4 and 5, respectively, are sectional side views showing conventional scroll compressors.
Figure 5:
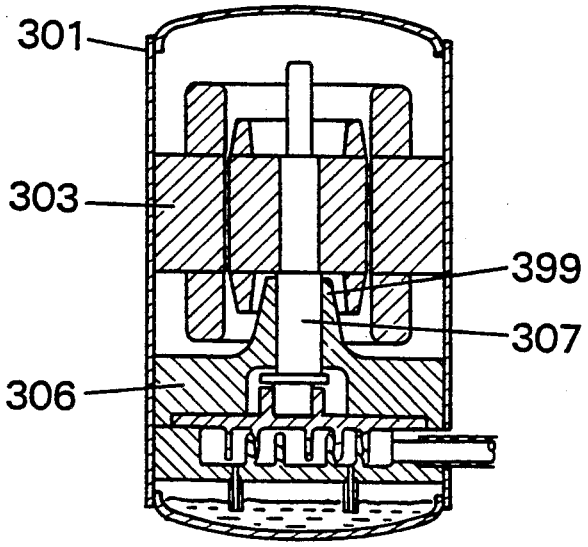

Moreover, in the above embodiment, the sectional dimension of the outside of the stator 3*b* of the motor 3 in FIG. 1 is the same at all the height. However, the sectional shape thereof can be staged as seen at the outer periphery at both the ends of the stator 3*b*′ in FIG. 3.

Still further, although a scroll type refrigerant compressor is disclosed in the above embodiment, effects similar to the above description can be expected in other compressors like a reciprocation type or a rotary type compressor.

As mentioned above, according to the invention, an electric motor and a compressor are housed in an enclosing vessel, a drive spindle of the compressor is linked with a rotor of the electric motor, the drive spindle is supported and a fixing member which is an element of the compressor is pressed into and fixed at the outer periphery of one end of a stator of the electric motor, a bearing frame by which the other end of the drive spindle is supported is pressed into and fixed at the outer periphery of the other end of the stator, and the fixing member and the outer peripheral portion of the pressing and fixing part of the stator on the bearing frame are pressed into and fixed on the inner wall of the above enclosing vessel, and all the component parts are so composed as for the axial centers thereof to be concentric, thereby causing scattering of the clearance between the inner diametered face of the stator of the electric motor and the outer face of the rotor to be reduced. Therefore, balance of electromagnetic attraction force exerting on between the stator and the rotor can be maintained, and power loss and wearing of the slideways of the bearings can be lessened by preventing abnormal load and/or abnormal noises resulting from biased electromagnetic attraction force to the fixing members which are component members of the compression portion which can support the drive spindle, the bearing frame and the drive spindle.

Since the distance between both bearings can be made longer by arranging the bearing members at both the sides of motor, compression load exerting on both the bearings can be roughly uniformly distributed, thereby causing the durability of the bearing to be increased. Moreover, the inclination of the drive spindle is small, and the inclination of the clearance between the above stator and the above rotor can be made small. For this reason, it is possible to maintain the balance of the electromagnetic attraction force exerting on between the stator and the rotor, and it is also possible to prevent seizure of the bearings resulting from biased contact of the slideways of the bearings due to inclination of the drive spindle.

Since the portion by which the stator of the electric motor is supported is formed of a sandwiched structure by contact under pressure with the stator, the bearing materials, and the enclosing vessel, it is possible to increase the rigidity of respective component members. For this reason, not only vibrations which may occur at the bearings can be lessened but also transmission of noises and vibrations onto the outer surface of the enclosing vessel can be prevented. Therefore, low vibration and low noise characteristics can be secured, and the durability of bearings can be increased.

Also according to this invention, since the material of the body frame whose thermal expansion coefficient is remarkably larger than that of the enclosing vessel, a thin, loop-shaped sleeve, which comprise a material whose thermal expansion coefficient corresponds to that of the enclosed vessel, is pressed into and fixed at the outer periphery at the other end of the body frame, and the extreme outer portion of the sleeve is internally tangential to and fixed at the enclosing casing, the temperature of a part of component materials of the compression portion and the enclosing vessel rises due to compression heat of fluid, friction heat of the slideways and heating of the electric motor during running the compressor and the temperature of a part of the component members of the compression portion is higher than that of the enclosing vessel whose outer surface is exposed to the atmosphere. Therefore, the thermal deformation of the outer periphery of a part of the component members of the compression portion is remarkably larger than that of the inner wall of the enclosing vessel and that of the inner and the outer peripheral portion of the sleeve, and thin, loop-shaped sleeve is expanded to increase the contact surface pressure among a part of the component members of the compression portion, the sleeve and the inner wall of the enclosing vessel, thereby causing the fixing among these three component members to be strengthened. In addition, since a minute deformation of the enclosing vessel occurs due to welding on assembling, a minute clearance which has been produced between the inner wall of the enclosing vessel and the sleeve can be completely eliminated by the expansion of the dimension of a part of the component members of the compression portion and sleeve. Accordingly, even though minute vibrations which may occur in accompanying with rotation of the drive spindle and compression of the fluid is transmitted to the inner wall of the enclosing vessel by way of a part of the component members of the compression portion, the enclosing vessel can be prevented from resonance together with the sleeve and a part of the component members of the compression portion, thereby causing vibrations and noises to be remarkably lessened.

Even though any rotation load exerts on the drive spindle and any bending moment load operates on the body frame by the drive spindle which makes so-called mashing movements as the outer peripheral portion at both the ends of the body frame is pressed into and fixed to the inner wall of the enclosing vessel, the axial center of the body frame will not be inclined to the inner wall of the enclosing vessel, an air gap can be maintained between the stator and the rotor of the electric motor at all times, and the inclination of rotor can be prevented, thereby causing the vibrations of the body frame and biased contacting of the bearings to be prevented and causing the bearings to be prevented from wearing.

Besides, the rigidity of the enclosing vessel is increased, minute vibrations due to expansion and contraction of the enclosing vessel which results from the discharge pulsation of the discharge fluid is decreased, thereby causing the strength of the welded portions of the enclosing vessel against fatigue to be increased. Therefore, the reliability as a pressure vessel can be heightened. In this way, the invention can provide an enclosed type electric compressor which can attain excellent effects, by virtue of various advantages mentioned aboves.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An enclosed type electric compressor comprising:

an electric motor including a rotor having a longitudinal axis and a stator having a longitudinal axis, said rotor being mounted for rotation with respect to said stator, said stator further including an outer periphery, a first end and a second end;

a compressor including a drive spindle having a longitudinal axis, a first end and a second end, said drive spindle being fixedly secured to said rotor for rotation therewith, said compressor further including a fixing member having a longitudinal axis and an outer periphery, said fixing member rotatably supporting said first end of said drive spindle and being pressed onto and fixed to said outer periphery of said stator at said first end thereof;

a bearing frame having a longitudinal axis and an outer periphery, said bearing frame rotatably supporting said second end of said drive spindle and being pressed onto and fixed to said outer periphery of said stator at said second end thereof; and an enclosing vessel for receiving said electric motor, said compressor and said bearing frame therein and including an inner wall, said outer periphery of said fixing member and said outer periphery of said bearing member being pressed onto and fixed to said inner wall of said enclosing member, said rotor, stator, drive spindle, fixing member and bearing frame being concentrically mounted within said enclosed vessel such that said longitudinal axes thereof are aligned.

2. The enclosed type electric compressor as recited in claim 1, wherein said bearing frame and said fixing member are constructed of a material having a first thermal expansion coefficient, said enclosing vessel including a cylindrical portion constructed of steel having a second thermal expansion coefficient, said first thermal expansion coefficient being greater than said second thermal expansion coefficient.

3. The enclosed type electric compressor as recited in claim 2, wherein said bearing frame and said fixing member are constructed of an aluminum alloy.

4. The enclosed type electric compressor as recited in claim 2, wherein said bearing frame and said fixing member are constructed of a composite material containing an aluminum alloy and carbon fibers.

5. The enclosed type electric compressor as recited in claim 2, wherein said bearing frame and said fixing member are constructed of a composite material containing carbon fibers and resin.

6. The enclosed type electric compressor as recited in claim 1, wherein said bearing frame and said fixing member are constructed of an aluminum alloy.

7. The enclosed type electric compressor as recited in claim 1, wherein said bearing frame and said fixing member are constructed of a composite material containing an aluminum alloy and carbon fibers.

8. The enclosed type electric compressor as recited in claim 1, wherein said bearing frame and said fixing member are constructed of a composite material containing carbon fibers and resin.

9. The enclosed type electric compressor as recited in claim 1, wherein said fixing member includes a body frame pressed onto and fixed to said outer periphery of said stator at said first end thereof, said body frame being constructed of a material having a first thermal expansion coefficient, said enclosing vessel being constructed of a material having a second thermal expansion coefficient, said first thermal expansion coefficient being grater than said second thermal expansion coefficient; and a thin, loop-shaped sleeve constructed of a material having said second thermal expansion coefficient, said sleeve being pressed onto and fixed to an outer periphery of said body frame, said sleeve corresponding to and being fixed to said inner wall of said enclosing vessel.

10. The enclosed type electric compressor as recited in claim 1, wherein said bearing frame is used as said fixing member of said compressor.

* * * * *